US011519577B2

(12) United States Patent
Chiang et al.

(10) Patent No.: US 11,519,577 B2
(45) Date of Patent: Dec. 6, 2022

(54) VEHICLE LAMP DEVICE AND PROJECTION LENS THEREFOR

(71) Applicant: Young Optics Inc., Hsinchu (TW)

(72) Inventors: Chen-An Chiang, Hsinchu (TW); S-Wei Chen, Hsinchu (TW)

(73) Assignee: YOUNG OPTICS INC., Hsinchu Science Park (TW)

( * ) Notice: Subject to any disclaimer, the term of this patent is extended or adjusted under 35 U.S.C. 154(b) by 0 days.

(21) Appl. No.: 17/469,120

(22) Filed: Sep. 8, 2021

(65) Prior Publication Data

US 2022/0275918 A1 Sep. 1, 2022

(30) Foreign Application Priority Data

Feb. 26, 2021 (TW) ..... 110106989
Apr. 27, 2021 (TW) ..... 110115182

(51) Int. Cl.
*F21S 41/153* (2018.01)
*F21S 41/27* (2018.01)
*F21S 41/275* (2018.01)
*F21Y 115/10* (2016.01)

(52) U.S. Cl.
CPC ..... *F21S 41/153* (2018.01); *F21S 41/27* (2018.01); *F21S 41/275* (2018.01); *F21Y 2115/10* (2016.08)

(58) Field of Classification Search
CPC ..... F21S 41/153; F21S 41/275; F21S 41/27
See application file for complete search history.

(56) References Cited

U.S. PATENT DOCUMENTS

| | | | | |
|---|---|---|---|---|
| 9,074,747 | B2 | 7/2015 | Abe | |
| 11,384,917 | B1 * | 7/2022 | Chen | F21S 41/265 |
| 2019/0257492 | A1 * | 8/2019 | Motohashi | F21S 41/143 |
| 2019/0302403 | A1 * | 10/2019 | Lai | G02B 13/0035 |
| 2020/0041771 | A1 * | 2/2020 | Peng | G02B 7/028 |
| 2020/0400928 | A1 * | 12/2020 | Wang | G02B 13/18 |
| 2022/0128209 | A1 * | 4/2022 | Fischer | F21S 41/25 |

FOREIGN PATENT DOCUMENTS

| | | | |
|---|---|---|---|
| CN | 104471310 | A | 3/2015 |
| CN | 105351839 | B | 2/2018 |
| TW | I546491 | B | 8/2016 |
| TW | I637125 | B | 10/2018 |

* cited by examiner

*Primary Examiner* — Bryon T Gyllstrom
*Assistant Examiner* — Christopher E Dunay
(74) *Attorney, Agent, or Firm* — Muncy, Geissler, Olds & Lowe, P.C.

(57) ABSTRACT

A vehicle lamp device includes a matrix-type image light source, a projection lens, an aperture stop and a vehicle lampshade. The projection lens is disposed downstream from and in a light path of the image light source, and the projection lens consists essentially of two or three lenses with refractive powers. The aperture stop is disposed between two outermost lenses respectively at two opposite ends of the projection lens. Two outermost lens surfaces at the two opposite ends of the projection lens have a first optical center and a second optical center respectively, and a distance between the first optical center and the second optical center is in a range between 30 mm and 85 mm.

20 Claims, 20 Drawing Sheets

| First embodiment | | | | | |
|---|---|---|---|---|---|
| Object description | Surface | Radius of curvature (mm) | Interval (mm) | Refractive index | Abbe number |
| First lens 110 (biconvex) | 112 | 60.27 | 9.20 | 1.49 | 57.44 |
| | 114 | -211.49 | 31.82 | | |
| Second lens 120 (biconvex) Stop ST | 122 | 55.15 | 8.38 | 1.52 | 64.20 |
| | 124 | -55.15 | 0.20 | | |
| Third lens 130 (meniscus) | 132 | 19.67 | 11.57 | 1.57 | 56.06 |
| | 134 | 41.57 | 7.52 | | |
| image light source 200 | LS | inf. | 0.00 | | |

| First embodiment | | | | | |
|---|---|---|---|---|---|
| Object description | Surface | Radius of curvature (mm) | Interval (mm) | Refractive index | Abbe number |
| First lens 110 (biconvex) | 112 | 60.27 | 9.20 | 1.49 | 57.44 |
| | 114 | -211.49 | 31.82 | | |
| Second lens 120 (biconvex) Stop ST | 122 | 55.15 | 8.38 | 1.52 | 64.20 |
| | 124 | -55.15 | 0.20 | | |
| Third lens 130 (meniscus) | 132 | 19.67 | 11.57 | 1.57 | 56.06 |
| | 134 | 41.57 | 7.52 | | |
| image light source 200 | LS | inf. | 0.00 | | |

FIG. 1B

| Surface | conic constant | 4th order aspheric coefficient | 6th order aspheric coefficient | 8th order aspheric coefficient | 10th order aspheric coefficient |
|---|---|---|---|---|---|
| 112 | -15.96 | 1.296E-05 | -2.158E-08 | 1.305E-11 | -4.355E-15 |
| 114 | 45.64 | 8.793E-06 | -1.319E-08 | 4.947E-12 | 1.569E-14 |

| Surface | conic constant | 12th order aspheric coefficient | 14th order aspheric coefficient | 16th order aspheric coefficient |
|---|---|---|---|---|
| 112 | -15.96 | 1.105E-17 | 2.086E-20 | -8.412E-24 |
| 114 | 45.64 | 7.915E-18 | -1.504E-21 | 3.118E-23 |

FIG. 1C

| Second embodiment | | | | | |
|---|---|---|---|---|---|
| Object description | Surface | Radius of curvature (mm) | Interval (mm) | Refractive index | Abbe number |
| First lens 110 (biconvex) | 112 | 54.09 | 10.81 | 1.49 | 57.44 |
| | 114 | -184.87 | 29.60 | | |
| Second lens 120 (biconvex) Stop ST | 122 | 60.56 | 9.86 | 1.52 | 64.20 |
| | 124 | -60.56 | 0.20 | | |
| Third lens 130 (meniscus) | 132 | 18.60 | 11.17 | 1.52 | 64.20 |
| | 134 | 96.45 | 6.96 | | |
| image light source 200 | LS | inf. | 0.00 | | |

FIG. 2B

| Surface | conic constant | 4th order aspheric coefficient | 6th order aspheric coefficient | 8th order aspheric coefficient | 10th order aspheric coefficient |
|---|---|---|---|---|---|
| 112 | -17.50 | 1.313E-05 | -2.174E-08 | 1.260E-11 | -2.497E-15 |
| 114 | 40.85 | 8.071E-06 | -1.331E-08 | 6.496E-12 | 1.696E-14 |

| Surface | conic constant | 12th order aspheric coefficient | 14th order aspheric coefficient | 16th order aspheric coefficient |
|---|---|---|---|---|
| 112 | -17.50 | 1.583E-17 | 2.184E-20 | -1.756E-23 |
| 114 | 40.85 | 5.801E-18 | -1.775E-21 | 5.058E-23 |

FIG. 2C

| Third embodiment | | | | | |
|---|---|---|---|---|---|
| Object description | Surface | Radius of curvature (mm) | Interval (mm) | Refractive index | Abbe number |
| First lens 110 (meniscus) | 112 | 38.67 | 10.62 | 1.58 | 30.37 |
| | 114 | 85.22 | 4.98 | | |
| Stop ST | | inf | 8.24 | | |
| Second lens 120 (biconvex) | 122 | 128.19 | 15.00 | 1.50 | 81.61 |
| | 124 | -38.93 | 7.62 | | |
| Third lens 130 (meniscus) | 132 | 19.23 | 16.05 | 1.50 | 81.61 |
| | 134 | 68.71 | 5.44 | | |
| image light source 200 | LS | inf. | 0.00 | | |

FIG. 3B

| Surface | conic constant | 4th order aspheric coefficient | 6th order aspheric coefficient | 8th order aspheric coefficient | 10th order aspheric coefficient |
|---|---|---|---|---|---|
| 112 | -11.10 | 1.886E-05 | -1.828E-08 | 4.805E-12 | -2.100E-14 |
| 114 | 3.22 | 1.514E-05 | -1.597E-08 | -5.591E-12 | 4.135E-15 |

FIG. 3C

| Fourth embodiment | | | | | |
|---|---|---|---|---|---|
| Object description | Surface | Radius of curvature (mm) | Interval (mm) | Refractive index | Abbe number |
| First lens 110 (meniscus) | 112 | 40.61 | 11.55 | 1.58 | 30.37 |
| | 114 | 110.71 | 4.40 | | |
| Stop ST | | inf | 8.87 | | |
| Second lens 120 (biconvex) | 122 | 105.47 | 15.00 | 1.49 | 70.44 |
| | 124 | -42.33 | 7.73 | | |
| Third lens 130 (meniscus) | 132 | 18.19 | 15.76 | 1.49 | 70.44 |
| | 134 | 72.87 | 4.58 | | |
| image light source 200 | LS | inf. | 0.00 | | |

FIG. 4B

| Surface | conic constant | 4th order aspheric coefficient | 6th order aspheric coefficient | 8th order aspheric coefficient | 10th order aspheric coefficient |
|---|---|---|---|---|---|
| 112 | -10.10 | 1.791E-05 | -1.742E-08 | 8.353E-12 | -1.671E-14 |
| 114 | 4.62 | 1.548E-05 | -1.477E-08 | -4.817E-12 | 4.153E-15 |

FIG. 4C

| Fifth embodiment | | | | | |
|---|---|---|---|---|---|
| Object description | Surface | Radius of curvature (mm) | Interval (mm) | Refractive index | Abbe number |
| First lens 110 (biconvex) | 112 | 113.82 | 6.75 | 1.49 | 37.44 |
| | 114 | -92.66 | 29.60 | | |
| Stop ST | | inf | 2.44 | | |
| Second lens 120 (biconvex) | 122 | 39.44 | 15.00 | 1.52 | 64.20 |
| | 124 | -98.62 | 6.03 | | |
| Third lens 130 (meniscus) | 132 | 15.78 | 9.26 | 1.52 | 64.20 |
| | 134 | 96.31 | 5.05 | | |
| image light source 200 | LS | inf. | 0.00 | | |

FIG. 5B

| Surface | conic constant | 4th order aspheric coefficient | 6th order aspheric coefficient | 8th order aspheric coefficient | 10th order aspheric coefficient |
|---|---|---|---|---|---|
| 112 | 6.40 | 3.284E-06 | -1.596E-08 | -2.727E-12 | 2.142E-14 |
| 114 | -3.11 | 5.277E-06 | -1.379E-08 | -4.249E-12 | 2.334E-14 |

FIG. 5C

| Sixth embodiment | | | | | |
|---|---|---|---|---|---|
| Object description | Surface | Radius of curvature (mm) | Interval (mm) | Refractive index | Abbe number |
| First lens 110 (meniscus) | 112 | 34.91 | 10.16 | 1.49 | 57.44 |
| | 114 | 113.31 | 40.08 | | |
| Stop ST | | inf | -3.94 | | |
| Second lens 120 (meniscus) | 122 | 18.82 | 20.65 | 1.81 | 25.48 |
| | 124 | 89.27 | 3.56 | | |
| image light source 200 | LS | inf. | 0.00 | | |

FIG. 6B

| Surface | conic constant | 4th order aspheric coefficient | 6th order aspheric coefficient | 8th order aspheric coefficient | 10th order aspheric coefficient |
|---|---|---|---|---|---|
| 112 | -0.38 | 8.411E-06 | -6.005E-08 | 1.203E-10 | -6.673E-14 |
| 114 | 11.55 | -8.313E-06 | 5.716E-09 | -2.012E-11 | 6.161E-14 |

| Surface | conic constant | 12th order aspheric coefficient | 14th order aspheric coefficient | 16th order aspheric coefficient |
|---|---|---|---|---|
| 112 | -0.38 | -1.240E-16 | 2.116E-19 | -1.429E-22 |
| 114 | 11.55 | -6.691E-18 | -2.144E-19 | 1.711E-22 |

FIG. 6C

| Seventh embodiment | | | | | |
|---|---|---|---|---|---|
| Object description | Surface | Radius of curvature (mm) | Interval (mm) | Refractive index | Abbe number |
| First lens 110 (meniscus) | 112 | 30.66 | 11.06 | 1.49 | 57.44 |
| | 114 | 440.40 | 16.91 | | |
| Stop ST | | inf | 1.65 | | |
| Second lens 120 (biconvex) | 122 | 23.07 | 12.03 | 1.76 | 47.82 |
| Third lens 130 (meniscus) | 132 | -17.29 | 8.09 | 1.85 | 23.88 |
| | 134 | -60.34 | 6.00 | | |
| image light source 200 | LS | inf. | 0.00 | | |

FIG. 7B

| Surface | conic constant | 4th order aspheric coefficient | 6th order aspheric coefficient | 8th order aspheric coefficient | 10th order aspheric coefficient |
|---|---|---|---|---|---|
| 112 | 0.251 | 8.217E-06 | 3.485E-09 | 1.020E-11 | 2.735E-14 |
| 114 | 50.00 | 2.317E-05 | -6.022E-09 | 4.519E-11 | 4.167E-14 |

| Surface | conic constant | 12th order aspheric coefficient | 14th order aspheric coefficient | 16th order aspheric coefficient |
|---|---|---|---|---|
| 112 | 0.251 | 2.561E-17 | -1.823E-19 | -1.250E-22 |
| 114 | 50.00 | -5.912E-16 | 2.607E-19 | 6.051E-22 |

FIG. 7C

| Eighth embodiment | | | | | |
|---|---|---|---|---|---|
| Object description | Surface | Radius of curvature (mm) | Interval (mm) | Refractive index | Abbe number |
| First lens 110 (meniscus) | 112 | 44.19 | 10.71 | 1.58 | 30.37 |
| | 114 | 524.91 | 1.24 | | |
| Stop ST | | inf | 25.54 | | |
| Second lens 120 (biconvex) | 122 | 35.41 | 12.49 | 1.83 | 42.73 |
| Third lens 130 (meniscus) | 132 | -20.01 | 14.00 | 1.85 | 23.79 |
| | 134 | -135.54 | 7.66 | | |
| image light source 200 | LS | inf. | 0.00 | | |

FIG. 8B

| Surface | conic constant | 4th order aspheric coefficient | 6th order aspheric coefficient |
|---|---|---|---|
| 112 | -4.620 | 7.081E-06 | -3.610E-09 |
| 114 | 100.00 | 2.949E-06 | -2.510E-09 |

FIG. 8C

| Ninth embodiment | | | | | |
|---|---|---|---|---|---|
| Object description | Surface | Radius of curvature (mm) | Interval (mm) | Refractive index | Abbe number |
| First lens 110 (meniscus) | 112 | 25.24 | 12.99 | 1.49 | 57.44 |
| | 114 | 120.25 | 18.60 | | |
| Stop ST | | inf | 0.25 | | |
| Second lens 120 (biconvex) | 122 | 22.34 | 12.43 | 1.74 | 49.34 |
| Third lens 130 (meniscus) | 132 | -17.21 | 4.99 | 1.85 | 23.78 |
| | 134 | -118.27 | 6.00 | | |
| image light source 200 | LS | inf. | 0.00 | | |

FIG. 9B

| Surface | conic constant | 4th order aspheric coefficient | 6th order aspheric coefficient | 8th order aspheric coefficient | 10th order aspheric coefficient |
|---|---|---|---|---|---|
| 112 | 0.169 | -1.255E-06 | -4.835E-10 | -4.679E-12 | 1.023E-14 |
| 114 | 28.97 | 1.077E-05 | -1.800E-08 | 6.130E-11 | 9.856E-14 |

| Surface | conic constant | 12th order aspheric coefficient | 14th order aspheric coefficient | 16th order aspheric coefficient |
|---|---|---|---|---|
| 112 | 0.169 | 3.255E-17 | -1.236E-19 | 9.023E-23 |
| 114 | 28.97 | -4.742E-16 | 3.911E-19 | 3.659E-22 |

FIG. 9C

| Tenth embodiment | | | | | |
|---|---|---|---|---|---|
| Object description | Surface | Radius of curvature (mm) | Interval (mm) | Refractive index | Abbe number |
| First lens 110 (meniscus) | 112 | 42.06 | 16.26 | 1.58 | 30.37 |
| | 114 | 265.01 | 18.96 | | |
| Stop ST | | inf | 5.07 | | |
| Second lens 120 (biconvex) | 122 | 33.32 | 12.61 | 1.83 | 42.73 |
| Third lens 130 (meniscus) | 132 | -18.46 | 15.98 | 1.85 | 23.79 |
| | 134 | -147.18 | 6.10 | | |
| image light source 200 | LS | inf. | 0.00 | | |

FIG. 10B

| Surface | conic constant | 4th order aspheric coefficient | 6th order aspheric coefficient |
|---|---|---|---|
| 112 | -4.459 | 8.047E-06 | -2.840E-09 |
| 114 | 90.04 | 4.645E-06 | -4.787E-09 |

FIG. 10C

VEHICLE LAMP DEVICE AND PROJECTION LENS THEREFOR

BACKGROUND OF THE INVENTION a. Field of the Invention

The invention relates to a vehicle lamp device and a projection lens for the vehicle lamp device.

b. Description of the Related Art

In order to improve driving safety, the distribution of light fields and brightness of vehicle headlights need to meet specific requirements. Besides, how to decrease power consumption and improve luminous efficiency is always a major concern of automotive lighting designers.

A typical light source, such as halogen lamps, metal lamps, LED lamps, etc, cannot be directly used as a vehicle headlight without creating a light field suitable for the vehicle headlight. Currently, a vehicle headlight often includes non-imaging optics to guide or modify illumination beams emitted from a light source to comply with light pattern requirements fix vehicle headlights specified in government regulations, Therefore, it would be desirable to optimize light patterns of a vehicle headlight to provide proper brightness and light fields to improve driving safety and pedestrian warning effects.

The information disclosed in this "BACKGROUND OF THE INVENTION" section is only for enhancement understanding of the background of the invention and therefore it may contain information that does not form the prior art already known to a person of ordinary skill in the art. Furthermore, the information disclosed in this "BACKGROUND OF THE INVENTION" section does not mean that one or more problems to be solved by one or more embodiments of the invention is acknowledged by a person of ordinary skill in the art.

BRIEF SUMMARY OF THE INVENTION

The invention provides a vehicle lamp device and a projection lens for the vehicle lamp device.

According to one aspect of the present disclosure, a vehicle lamp device includes a matrix-type image light source, a projection lens, an aperture stop and a vehicle lampshade. The projection lens is disposed downstream from and in a light path of the matrix-type image light source, and the projection lens consists essentially of two or three lenses with refractive powers. The aperture stop is disposed between two outermost lenses respectively at two opposite ends of the projection lens. Two outermost lens surfaces at the two opposite ends of the projection lens have a first optical center and a second optical center respectively, and a distance between the first optical center and the second optical center is in a range between 30 mm and 85 mm. The vehicle lampshade is disposed downstream from and in a light path of the projection lens.

According to another aspect of the present disclosure, a projection lens for a vehicle lamp includes two or three lenses with refractive powers and an aperture stop. The aperture stop is disposed between two outermost lenses respectively at two opposite ends of the projection lens. An F-number of the projection lens is in a range between 0.6 and 0.85, and an aspect ratio of the projection lens is in a range between 2.5:1 and 6:1. Two outermost lens surfaces at the two opposite ends of the projection lens have a first optical center and a second optical center respectively, and a distance between the first optical center and the second optical center being in a range between 30 mm and 85 mm.

According to another aspect of the present disclosure, a projection lens for a vehicle lamp includes an aspheric first lens and a compound lens arranged in order from a magnified side to a minified side and an aperture stop. A lens diameter of the first lens is greater than a lens diameter of the compound lens. The aperture stop is disposed between the compound lens and the magnified side, an F-number of the projection lens is in a range between 0.6 and 0.85, and an aspect ratio of the projection lens is in a range between 2:1 and 6:1.

In accordance with the above aspects, the vehicle lamp device and the projection lens may have a reduced number of lenses with refractive powers, large effective aperture and high luminous efficiency for lighting or projection, and may comply with government regulations specifying safety requirements for vehicle lighting. Therefore, the design purposes of low fabrications costs, low energy consumption, and enhanced lighting and warning effects can be achieved. In addition, the projection lens in accordance with the above embodiments has a reduced total track length to enhance the assembly flexibility under the condition that the projection lens is used in vehicle lighting equipments such as a vehicle lamp device.

Other objectives, features and advantages of the invention will be further understood from the further technological features disclosed by the embodiments of the invention wherein there are shown and described preferred embodiments of this invention, simply by way of illustration of modes best suited to carry out the invention.

DETAILED DESCRIPTION OF THE INVENTION

In the following detailed description of the preferred embodiments, directional terminology, such as "top," "bottom," "front," "back," etc., is used with reference to the orientation of the Figure(s) being described. The components of the invention can be positioned in a number of different orientations. As such, the directional terminology is used for purposes of illustration and is in no way limiting. Further, "First," "Second," etc., as used herein, are used as labels for nouns that they precede, and do not imply any type of ordering (e.g., spatial, temporal, logical, etc.).

Figure 1A:
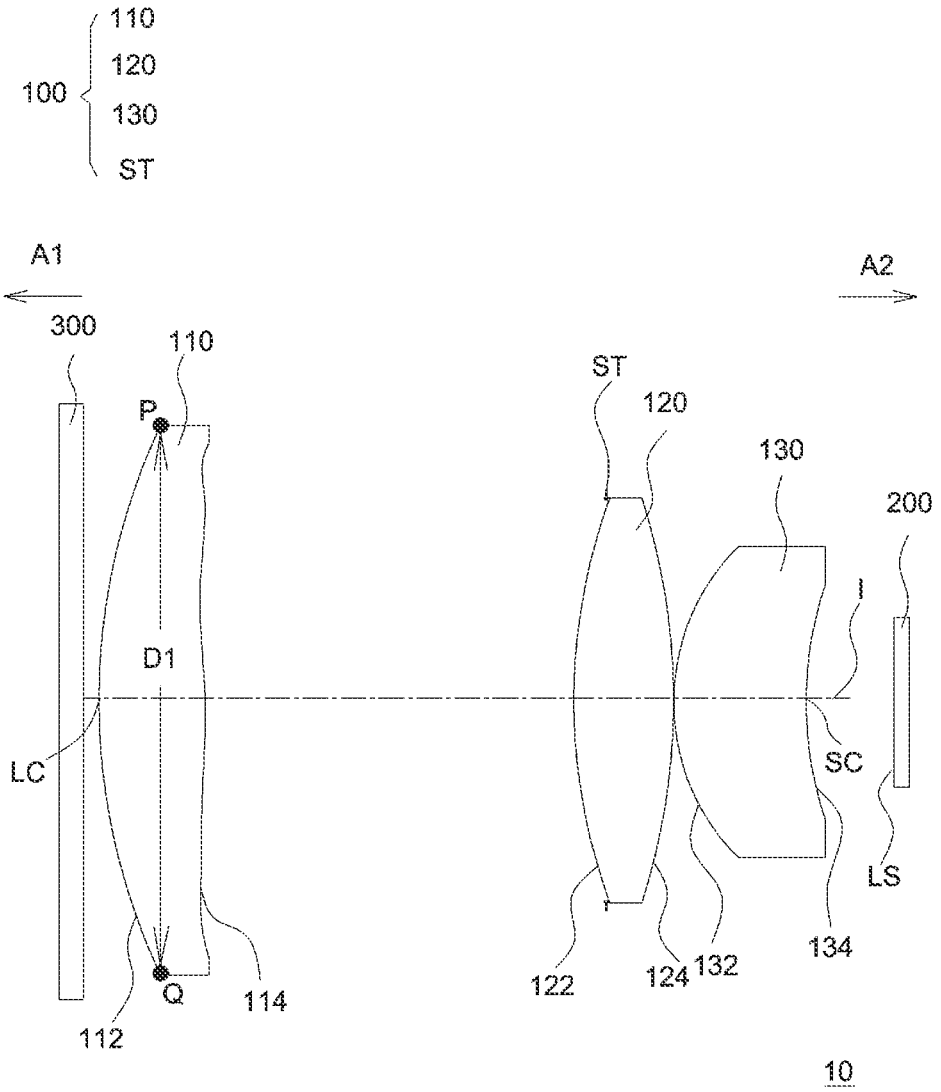
FIG. 1A shows a schematic cross-section of a vehicle lamp device in accordance with a first embodiment of the invention, and FIGS. 1B and 1C respectively show detailed optical data and aspheric coefficients of the vehicle lamp device of FIG. 1A.

FIG. 1A shows a schematic cross-section of a vehicle lamp device in accordance with a first embodiment of the invention. As shown in FIG. 1A, the embodiment provides an automobile illumination or projection device having a reduced number of lenses, a large effective aperture and high luminous efficiency. In this embodiment, the vehicle lamp device 10 includes a projection lens 100, a matrix-type image light source 200, and a vehicle lampshade/lamp cover 300. The matrix-type image light source 200 may provide an image beam (not shown), and the projection lens 100 is disposed downstream from and in a light path of the matrix-type image light source 200 to project image beams of the vehicle lamp device 10 to a target (not shown) such as a road surface or a wall surface. The vehicle lampshade/lamp cover 300 is disposed downstream from and in a light path of the projection lens 100. The image beams emitted from the projection lens 100 pass through the vehicle lampshade/lamp cover 300 and reaches a target. The vehicle lampshade/lamp cover 300 may further modify the image beams and may have a function of protecting the projection lens 100, the matrix-type image light source 200 or other component of the vehicle lamp device 10, but the invention is not limited thereto. In one embodiment, the vehicle lamp device 10 may be installed on a car to serve as a high beam light, a low beam light, a stop light, a brake light, a reversing light, a tail light, a fog light, a license plate light, a daytime running light, a turn signal, etc, but the invention is not limited thereto.

In this embodiment, the matrix-type image light source 200 may be a micro LED array or a digital micromirror device (DMD), but the invention is not limited thereto. The matrix-type image light source 200 may provide image beams, and the projection lens 100 may project the image beams onto a road surface or a wall surface, complying with government regulations specifying vehicle equipment requirements, to achieve safe driving and pedestrian warning effects. For example, the image beams may have high intensity without forming specific geometric patterns to serve as front lighting that needs superior brightness and should comply with government safety regulations. Alternatively, the image beams may carry specific geometric patterns if desired. The geometric patterns may include, but are not limited to, an arrow, a square, a triangle, a circle, etc. to serve as indication patterns or signals on driving.

FIG. 1B shows detailed optical data of a vehicle lamp device in accordance with the first embodiment of the invention, and aspheric coefficients of the vehicle lamp device are shown in FIG. 1C. Referring to FIGS. 1A-1C, a projection lens 100 may include two or three lenses with refractive powers; that is, the projection lens 100 may be a lens assembly of two lenses with non-zero refractive powers or a lens assembly of three lenses with non-zero refractive powers. The projection lens 100 may be used in a vehicle headlight. The projection lens 100 has an optical axis I that may be also an optical axis of the lens assembly of two or three lenses. The lens assembly of two or three lenses is disposed downstream from and in a light path of the image light source 200 to magnify image beams and cast image beams onto a target. The projection lens 100 may include at least one plastic lens. By way of example, a part of the lens assembly is made of a plastic lens, and another part of the lens assembly is made of a glass lens, but the invention is not limited thereto. Alternatively, the projection lens 100 may be formed from both glass and plastic, but the invention is not limited thereto. Further, the projection lens 100 may include a cement lens or not include a cement lens.

As shown in FIG. 1A, in this embodiment, the projection lens 100 includes three lenses with refractive powers, Specifically, the projection lens 100 may define a magnified side A1 towards the lampshade 300 and a minified side A2 towards the matrix-type image light source 200. The projection lens 100 includes a first lens 110, a second lens 120 and a third lens 130 arranged in order from the magnified side A1 to the minified side A2.

The first lens 110 is a plastic lens and an aspheric lens, and the first lens 110 has a positive refractive power and is a hi-convex lens. The magnified-side surface 112 of the first lens 110 facing the magnified side A1 is a convex surface, and the minified-side surface 114 of the first lens 110 facing the minified side A2 is a convex surface.

The second lens 120 has a positive refractive power and is a hi-convex lens. The magnified-side surface 122 of the second lens 120 facing the magnified side A1 is a convex surface, and the minified-side surface 124 of the second lens 120 facing the minified side A2 is a convex surface.

The third lens 130 has a positive refractive power and is a meniscus lens. The magnified-side surface 132 of the third lens 130 facing the magnified side A1 is a convex surface, and the minified-side surface 134 of the third lens 130 facing the minified side A2 is a concave surface. In other embodiment, the third lens 130 has a negative refractive power and is a meniscus lens.

The projection lens 100 may further include an aperture stop ST, and the aperture stop ST may be disposed between two outermost lenses respectively at two opposite ends of the projection lens 100. In this embodiment, the aperture stop ST is disposed between two outermost opposite lens surfaces of the projection lens 100, i.e. between the magnified-side surface 112 of the first lens 110 and the minified-side surface 134 of the third lens 130. An F-number of the projection lens 100 is in the range between 0.6 and 0.85. The aperture stop ST may be disposed on a lens surface of one of the lenses of the projection lens 100. In this embodiment, the aperture stop ST is disposed on a magnified-side surface 122 of the second lens 120. By way of example, the magnified-side surface 122 of the second lens 120 may define an aperture stop, or a mechanic piece surrounding the magnified-side surface 122 of the second lens 120 may be used to block out peripheral light to serve as an aperture stop.

In this embodiment, the surfaces 122 and 124 of the second lens 120 and the surfaces 132 and 134 of the third lens 130 may be an aspheric surface or a spherical surface. The second lens 120 and the third lens 130 may be a plastic lens or a glass lens, but the invention is not limited thereto. Further, the matrix-type image light source 200 has a light-emitting surface LS, and image beams are emitted from the image light source 200 via the light-emitting surface LS. The detailed optical data of this embodiment are shown in FIGS. 1B and 1C, where FIG. 1C lists aspheric coefficients of the magnified-side surface 112 and minified-side surface 114 of the first lens 110.

Besides, in this embodiment, a total track length TTL of the projection lens 100 is smaller than 80 mm, where the total track length TTL is defined as a distance along the optical axis I between the light-emitting surface LS of and a lens surface of the projection lens 100 furthest from the image light source 200 (i.e. magnified-side surface 112 of the first lens 110).

In this embodiment, two outermost lens surfaces at opposite ends of the projection lens 100 respectively have an optical center LC and an optical center SC, and a distance between the optical center LC and the optical center SC is in the range between 30 mm and 85 mm, and more preferably in the range between 54 mm and 76 mm. That is, an optical center of the magnified-side surface 112 of the first lens 110 and an optical center of the minified-side surface 134 of the third lens 130 may separate by a distance of 54 mm-76 mm, or an overall length of all lenses of the projection lens 100 measured along the optical axis I is in the range of 54 mm and 76 mm. In addition, an aspect ratio of the projection lens 100 is in the range between 2:1 and 6:1, and more preferably between 2.5:1 and 6:1, and the projection lens 100 may achieve a horizontal viewing angle of 14 to 40 degrees and a vertical viewing angle of 5 to 10 degrees to comply with government regulations specifying light pattern requirements.

In this embodiment, the matrix-type image light source 200 may include multiple micro LEDs. In this embodiment, the matrix-type image light source 200 may be constructed as a micro-LED array having a length of about 12.8 mm, a width of about 3.2 mm, a resolution of 256×64 pixels, and a pixel size of 50 micrometers. In this embodiment, the matrix-type image light source 200 has a spatial frequency of 5-15 line-pairs per millimeter. For example, the spatial frequency of the image light source 200 is 10 line-pairs per millimeter.

In this embodiment, an F-number of the vehicle lamp device 10 is in the range between 0.6 and 0.85 to provide a large effective aperture and enhance the luminous efficiency. Further, the vehicle lamp device 10 has an aspect ratio between 2.5:1 and 6:1 and may achieve a horizontal viewing angle of 14 to 40 degrees and a vertical viewing angle of 5 to 10 degrees to comply with government regulations specifying light pattern requirements. Besides, the above embodiment only requires a reduced number of lenses (such as three lenses with refractive powers) to achieve a range of 30 mm-85 mm of the overall length of lenses. The above embodiment may achieve a shorter total track length, and may include at least one plastic lens to reduce fabrication costs.

Figure 2A:
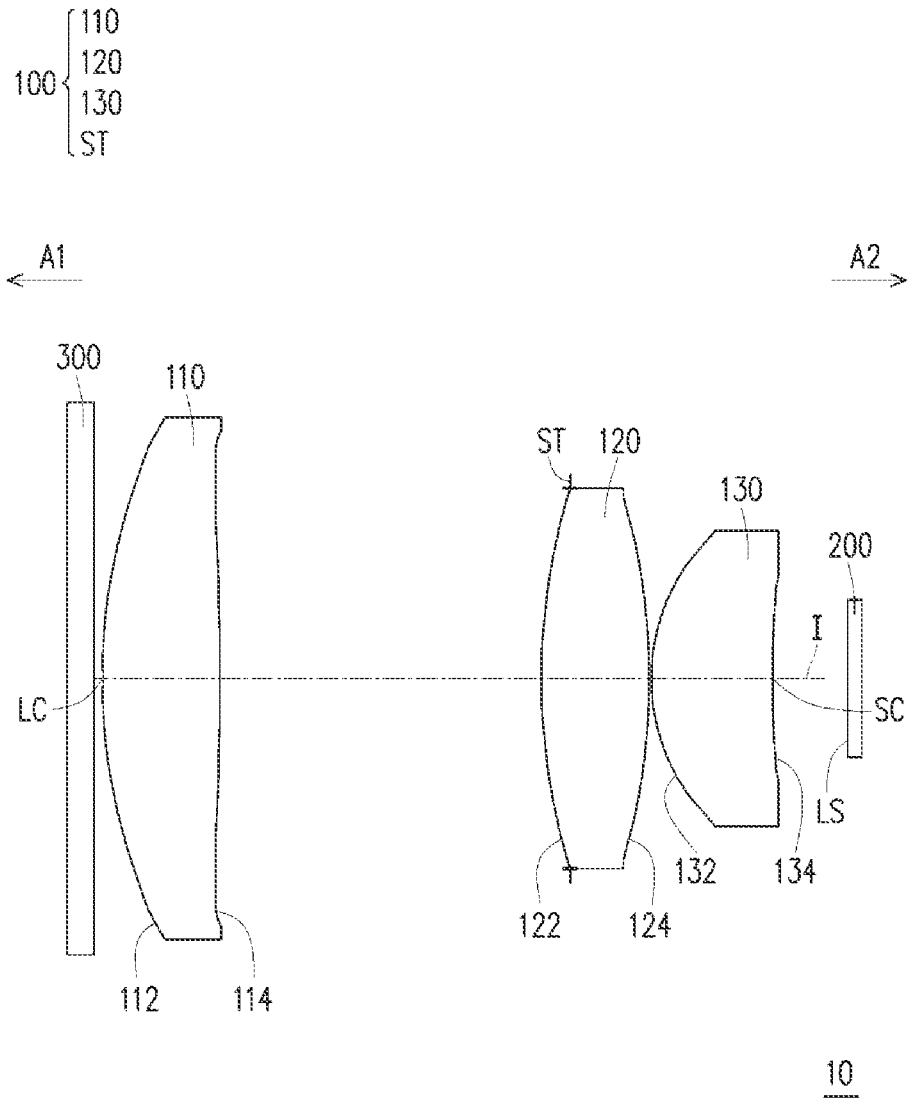
FIG. 2A shows a schematic cross-section of a vehicle lamp device in accordance with a second embodiment of the invention, and FIGS. 2B and 2C respectively show detailed optical data and aspheric coefficients of the vehicle lamp device of FIG. 2A.

FIG. 2A shows a schematic cross-section of a vehicle lamp device in accordance with a second embodiment of the invention, FIG. 2B shows detailed optical data of the vehicle lamp device of FIG. 2A, and FIG. 2C shows aspheric coefficients of the vehicle lamp device of FIG. 2A. Referring to FIGS. 2A-2C, the second embodiment of the vehicle lamp device 10 is similar to the first embodiment, except that the optical data of the second embodiment for the lenses 110, 120 and 130 shown in FIGS. 2B and 2C are different to those shown in FIGS. 1B and 1C.

Figure 3A:
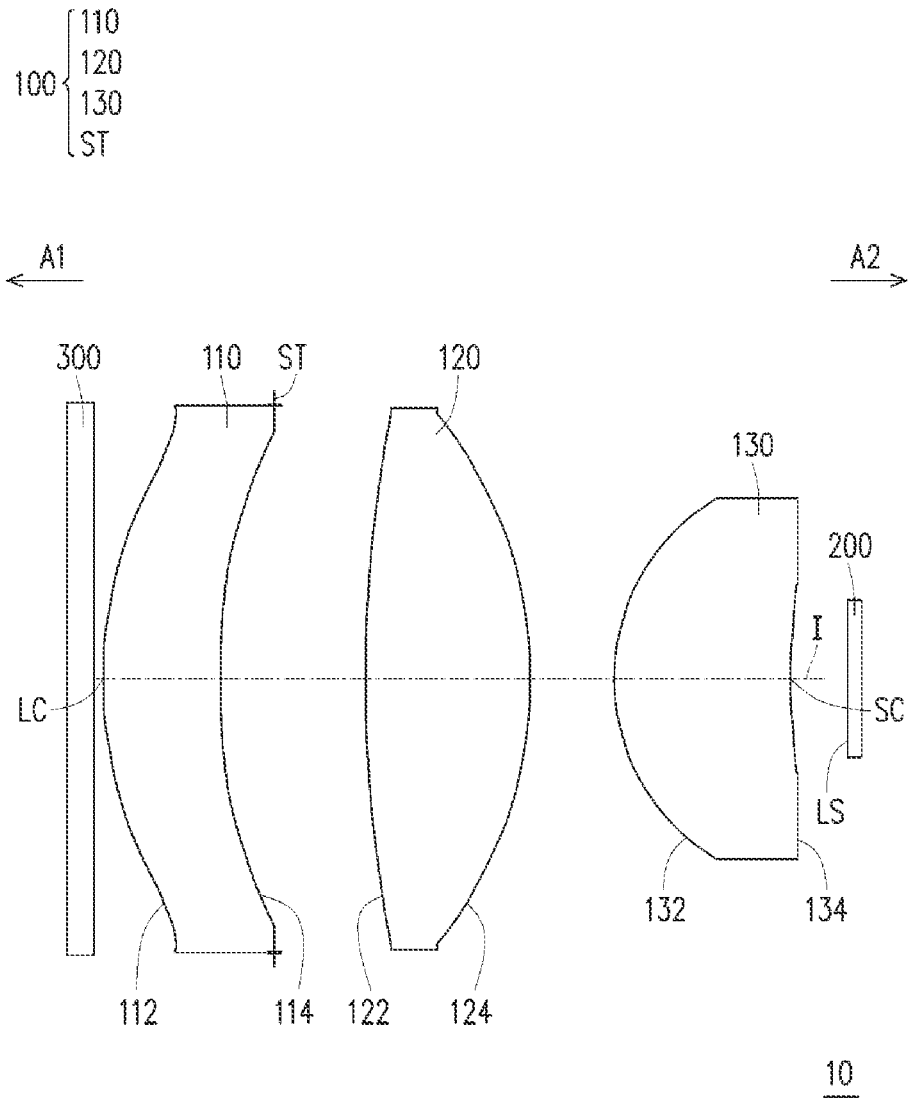
FIG. 3A shows a schematic cross-section of a vehicle lamp device in accordance with a third embodiment of the invention, and FIGS. 3B and 3C respectively show detailed optical data and aspheric coefficients of the vehicle lamp device of FIG. 3A.

FIG. 3A shows a schematic cross-section of a vehicle lamp device in accordance with a third embodiment of the invention, FIG. 3B shows detailed optical data of the vehicle lamp device of FIG. 3A, and FIG. 3C shows aspheric coefficients of the vehicle lamp device of FIG. 3A. Referring to FIGS. 3A-3C, the third embodiment of the vehicle lamp device 10 is similar to the first embodiment except for the differences described in the following. In the third embodiment, the first lens 110 is a meniscus lens, the minified-side surface 114 of the first lens 110 is a concave surface, and the aperture stop ST is disposed on the minified-side surface 114 of the first lens 110. By way of example, the minified-side surface 114 of the first lens 110 may define an aperture stop, or a mechanic piece surrounding the minified-side surface 114 of the first lens 110 may be used to block out peripheral light to serve as an aperture stop. Further, the optical data of the third embodiment for the lenses 110, 120 and 130 shown in FIGS. 3B and 3C are different to those shown in FIGS. 1B and 1C.

Besides, in the third embodiment, a thickness of the second lens 120 measured along the optical axis I is greater than 12 mm, and a distance between the second lens 120 and the third lens 130 measured along the optical axis I is greater than 1 mm; that is, a distance between the minified-side surface 124 of the second lens 120 and the magnified-side surface 132 of the third lens 130 measured along the optical axis I is greater than 1 mm. Besides, in this embodiment, a distance between the aperture stop ST and the second lens 120 measured along the optical axis I is greater than 2 mm.

Figure 4A:
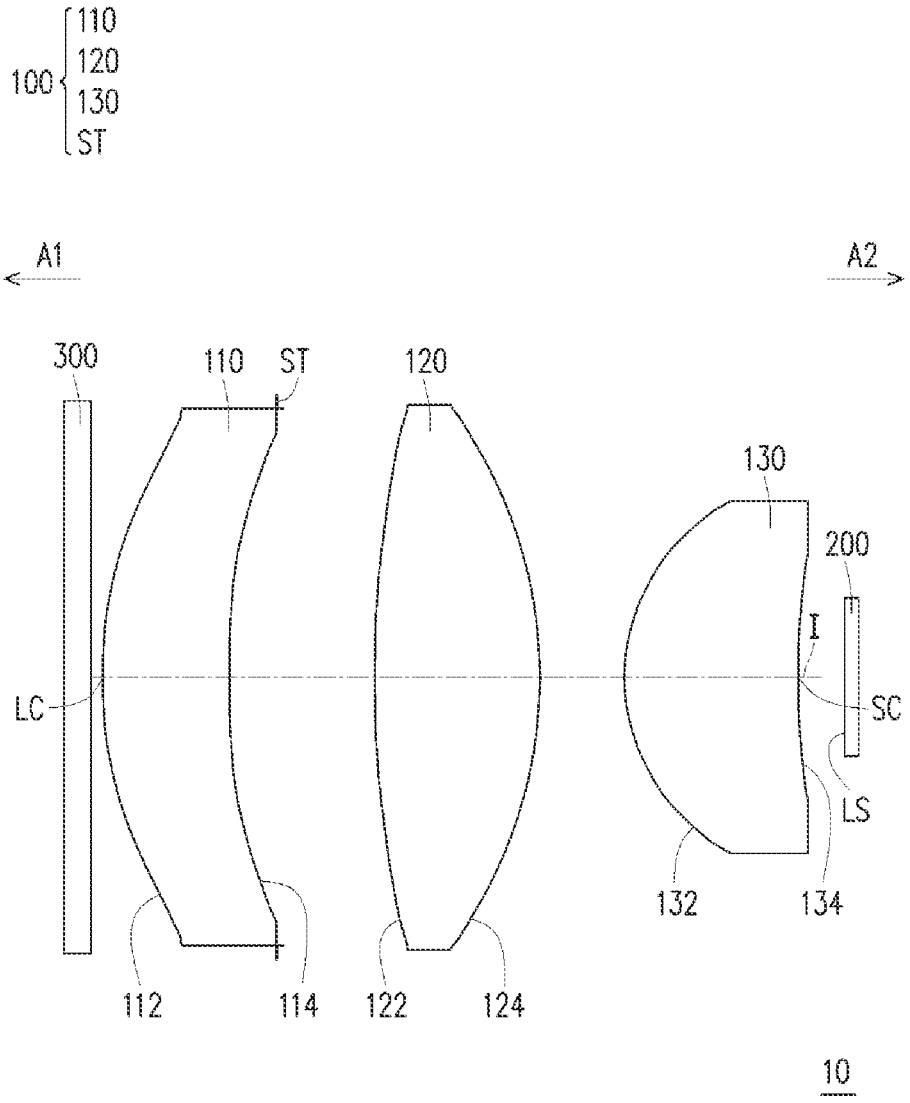
FIG. 4A shows a schematic cross-section of a vehicle lamp device in accordance with a fourth embodiment of the invention, and FIGS. 4B and 4C respectively show detailed optical data and aspheric coefficients of the vehicle lamp device of FIG. 4A.

FIG. 4A shows a schematic cross-section of a vehicle lamp device in accordance with a fourth embodiment of the invention, FIG. 4B shows detailed optical data of the vehicle lamp device of FIG. 4A, and FIG. 4C shows aspheric coefficients of the vehicle lamp device of FIG. 4A. Referring to FIGS. 4A-4C, the fourth embodiment of the vehicle lamp device 10 is similar to the third embodiment, except that the optical data of the fourth embodiment for the lenses 110, 120 and 130 shown in FIGS. 4B and 4C are different to those shown in FIGS. 3B and 3C.

Figure 5A:
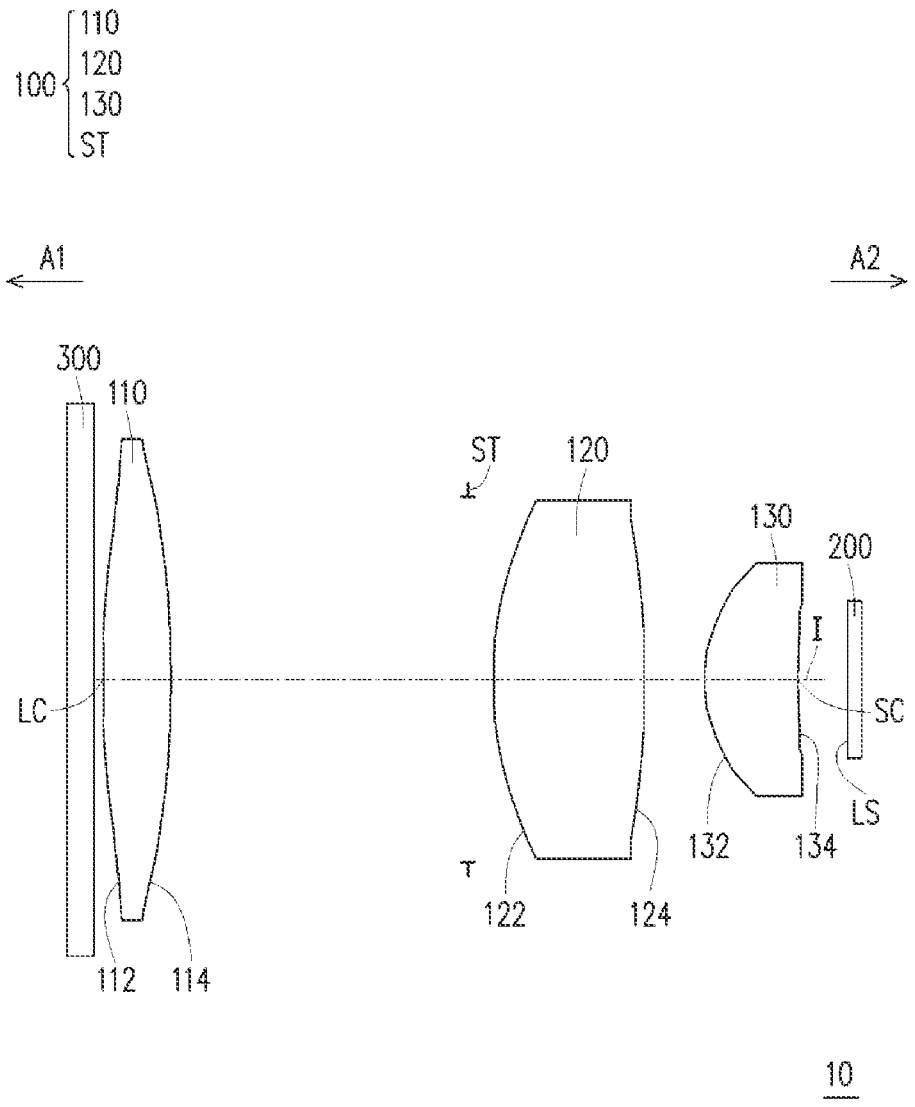
FIG. 5A shows a schematic cross-section of a vehicle lamp device in accordance with a fifth embodiment of the invention, and FIGS. 5B and 5C respectively show detailed optical data and aspheric coefficients of the vehicle lamp device of FIG. 5A.

FIG. 5A shows a schematic cross-section of a vehicle lamp device in accordance with a fifth embodiment of the invention, FIG. 5B shows detailed optical data of the vehicle lamp device of FIG. 5A, and FIG. 5C shows aspheric coefficients of the vehicle lamp device of FIG. 5A. Referring to FIGS. 5A-5C, the fifth embodiment of the vehicle lamp device 10 is similar to the third embodiment except for the differences described in the following. In the fifth embodiment, the first lens 110 is a bi-convex lens, the minified-side surface 114 of the first lens 110 is a convex surface, and the aperture stop ST is disposed between the first lens 110 and the second lens 120. Further, the optical data of the fifth embodiment for the lenses 110, 120 and 130 shown in FIGS. 5B and 5C are different to those shown in FIGS. 3B and 3C.

Figure 6A:
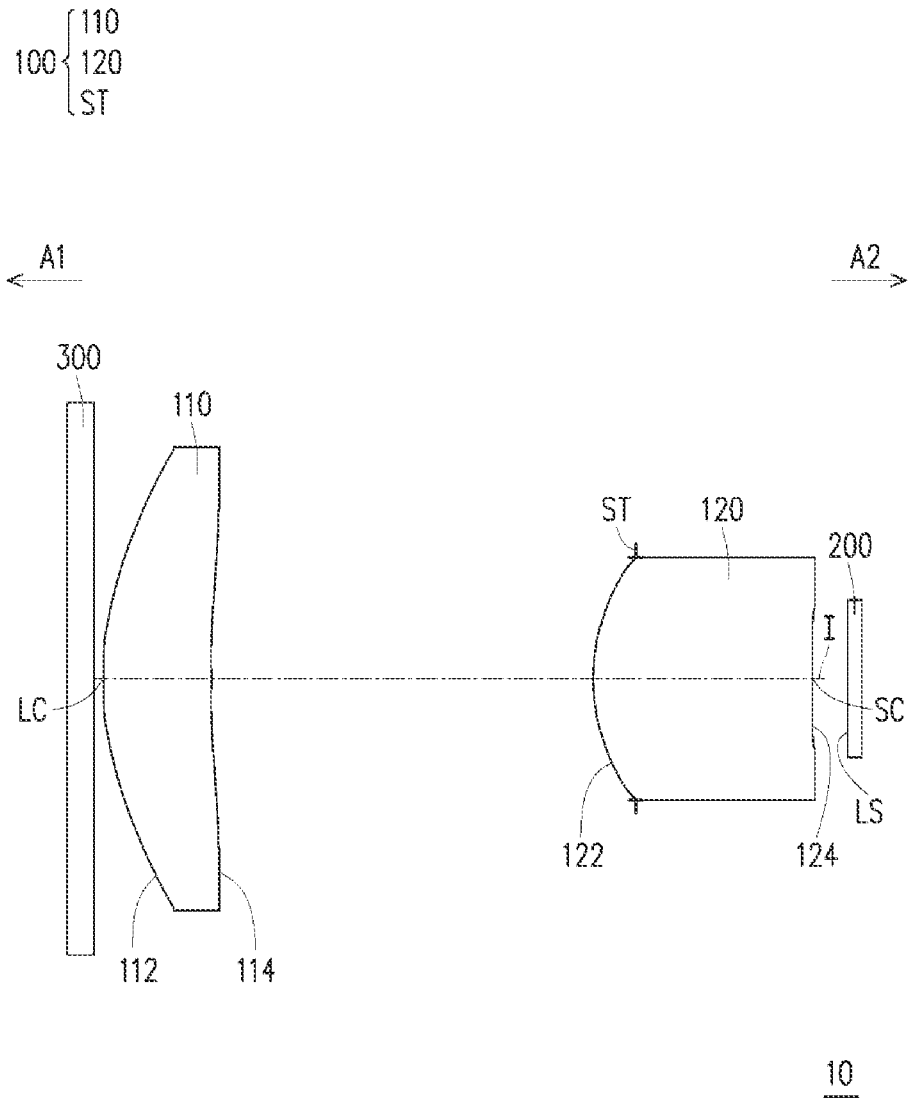
FIG. 6A shows a schematic cross-section of a vehicle lamp device in accordance with a sixth embodiment of the invention, and FIGS. 6B and 6C respectively show detailed optical data and aspheric coefficients of the vehicle lamp device of FIG. 6A.

FIG. 6A shows a schematic cross-section of a vehicle lamp device in accordance with a sixth embodiment of the invention, FIG. 6B shows detailed optical data of the vehicle lamp device of FIG. 6A, and FIG. 6C shows aspheric coefficients of the vehicle lamp device of FIG. 6A. Referring to FIGS. 6A-6C, the sixth embodiment of the vehicle lamp device 10 is similar to the first embodiment except for the differences described in the following. In this embodiment, the projection lens 100 includes two lenses with refractive powers. Specifically, the projection lens 100 includes the first lens 110 and the second lens 120 arranged in order from the magnified side A1 to the minified side A2.

The first lens 110 is a plastic lens and an aspheric lens. The first lens 110 has a positive refractive power and is a meniscus lens. The magnified-side surface 112 of the first lens 110 facing the magnified side A1 is a convex surface, and the minified-side surface 114 of the first lens 110 facing the minified side A2 is a concave surface.

The second lens 120 has a positive refractive power and is a meniscus lens. The magnified-side surface 122 of the second lens 120 facing the magnified side A1 is a convex surface, and the minified-side surface 124 of the second lens 120 facing the minified side A2 is a concave surface. Besides, in this embodiment, a thickness of the second lens 120 measured along the optical axis I is greater than 12 mm.

In this embodiment, the projection lens 100 may further include an aperture stop ST. In this embodiment, the aperture stop ST is disposed between two outermost opposite lens surfaces of the projection lens 100, i.e. the magnified-side surface 112 of the first lens 110 and the minified-side surface 124 of the second lens 120. An F-number of the projection lens 100 is in the range between 0.6 and 0.85. The aperture stop ST may be disposed on a lens surface of one of the lenses of the projection lens 100. In this embodiment, the aperture stop ST is disposed on the magnified-side surface 122 of the second lens 120. By way of example, the magnified-side surface 122 of the second lens 120 may define an aperture stop, or a mechanic piece surrounding the magnified-side surface 122 of the second lens 120 may be used to block out peripheral light to serve as an aperture stop.

In this embodiment, the magnified-side surfaces 122 and the minified-side surface 124 of the second lens 120 may be an aspheric surface or a spherical surface, and the second lens 120 may be a plastic lens or a glass lens, but the invention is not limited thereto. The detailed optical data of this embodiment are shown in FIGS. 6B and 6C, where FIG. 6C lists aspheric coefficients of the magnified-side surface 112 and minified-side surface 114 of the first lens 110.

Besides, in this embodiment, a total track length TTL of the projection lens 100 is smaller than 80 mm, where the total track length TTL is defined as a distance along the optical axis I between the light-emitting surface LS of and a lens surface of the projection lens 100 furthest from the image light source 200 (i.e. magnified-side surface 112 of the first lens 110).

In this embodiment, two outermost lens surfaces at opposite ends of the projection lens 100 respectively have an optical center LC and an optical center SC, and a distance between the optical center LC and the optical center SC is in the range between 54 mm and 76 mm. That is, an optical center of the magnified-side surface 112 of the first lens 110 and an optical center of the minified-side surface 124 of the second lens 120 may separate by a distance of 54 mm-76 mm, or an overall length of all lenses of the projection lens 100 measured along the optical axis I is in the range of 54 mm and 76 mm. In addition, an aspect ratio of the projection lens 100 is between 2.5:1 and 6:1, and the projection lens 100 may achieve a horizontal viewing angle of 14 to 40 degrees and a vertical viewing angle of 5 to 10 degrees to comply with government regulations specifying light pattern requirements.

Figure 7A:
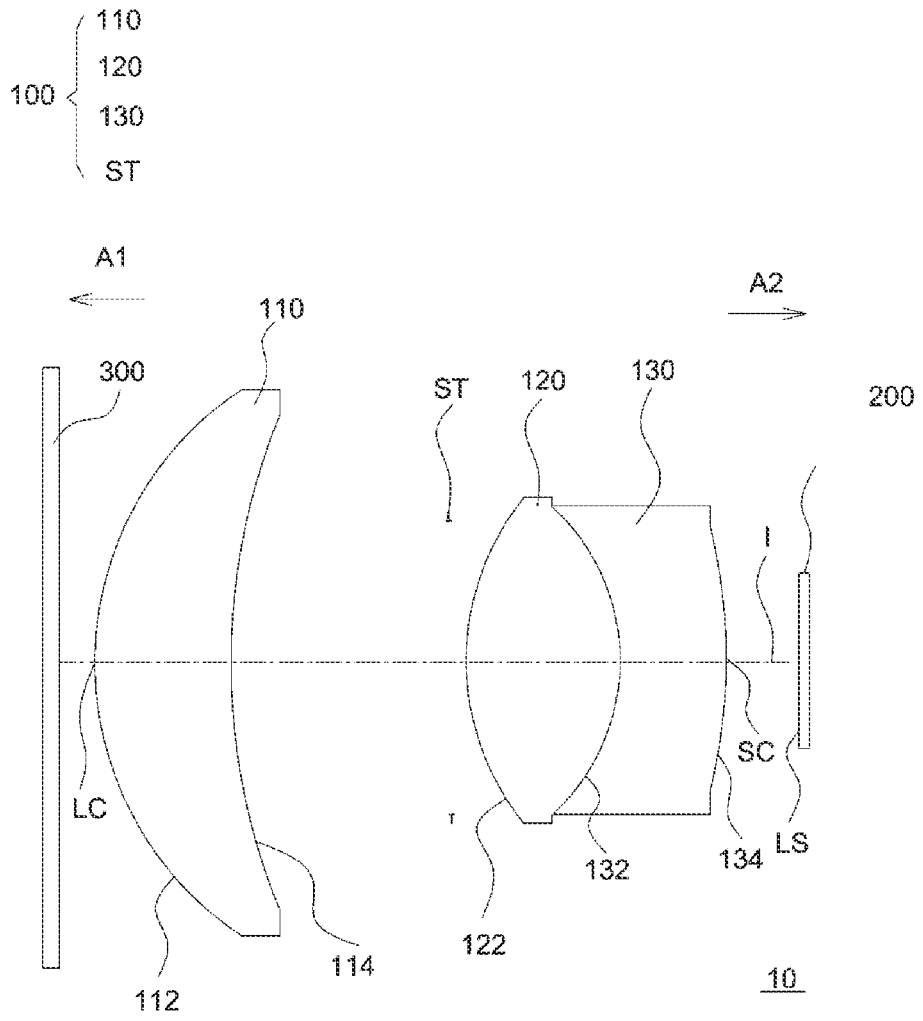
FIG. 7A shows a schematic cross-section of a vehicle lamp device in accordance with a seventh embodiment of the invention, and FIGS. 7B and 7C respectively show detailed optical data and aspheric coefficients of the vehicle lamp device of FIG. 7A.

FIG. 7A shows a schematic cross-section of a vehicle lamp device in accordance with a seventh embodiment of the invention, FIG. 7B shows detailed optical data of the vehicle lamp device of FIG. 7A, and FIG. 7C shows aspheric coefficients of the vehicle lamp device of FIG. 7A. Referring to FIGS. 7A-7C, the seventh embodiment of the vehicle lamp device 10 is similar to the first embodiment except for the differences described in the following. In this embodiment, the projection lens 100 has a compound lens composed of the second lens 120 and the third lens 130. Specifically, the projection lens 100 includes the first lens 110 and a compound lens composed of the second lens 120 and the third lens 130 arranged in order from the magnified side A1 to the minified side A2.

The first lens 110 is a plastic lens and an aspheric lens. The first lens 110 has a positive refractive power and is a meniscus lens. The magnified-side surface 112 of the first lens 110 facing the magnified side A1 is a convex surface, and the minified-side surface 114 of the first lens 110 facing the minified side A2 is a concave surface. The second lens 120 has a positive refractive power and is a bi-convex lens. The magnified-side surface 122 of the second lens 120 facing the magnified side A1 is a convex surface, and the minified-side surface 124 of the second lens 120 facing the minified side A2 is a convex surface. The third lens 130 has a positive refractive power and is a meniscus lens. The magnified-side surface 132 of the third lens 130 facing the magnified side A1 is a concave surface, and the minified-side surface 134 of the third lens 130 facing the minified side A2 is a convex surface. In this embodiment, a thickness of the second lens 120 measured along the optical axis I is greater than 6 mm. Further, adjoining surfaces of two adjacent lenses 120 and 130, either aspheric or spherical, may have an identical radius of curvature or a similar radius of curvature (a radius difference smaller than 0.005 mm), and the lenses 120 and 130 may be cemented together by an optical adhesive or fitted with each other by a mechanical piece to form a compound lens. In this embodiment, the compound lens is a cemented doublet in which lenses are cemented together by applying an optical adhesive.

In this embodiment, the projection lens 100 may further include an aperture stop ST. In this embodiment, the aperture stop ST is disposed between two outermost opposite lens surfaces of the projection lens 100, i.e. the magnified-side surface 112 of the first lens 110 and the minified-side surface 134 of the third lens 130. An F-number of the projection lens 100 is in the range between 0.6 and 0.85. In this embodiment, the aperture stop ST is disposed between the minified-side surface 114 of the first lens 110 and the magnified-side surface 122 of the second lens 120. By way of example, a mechanic piece disposed between the minified-side surface 114 of the first lens 110 and the magnified-side surface 122 of the second lens 120 is used to block out peripheral light to serve as an aperture stop.

In this embodiment, the magnified-side surface 122 of the second lens 120 and the surfaces 132 and 134 of the third lens 130 may be an aspheric surface or a spherical surface, and the second lens 120 and the third lens 130 may be a plastic lens or a glass lens, but the invention is not limited thereto. The detailed optical data of this embodiment are shown in FIGS. 7B and 7C, where FIG. 7C lists aspheric coefficients of the magnified-side surface 112 and minified-side surface 114 of the first lens 110.

In this embodiment, a total track length TTL of the projection lens 100 is smaller than 85 mm, where the total track length TTL is defined as a distance along the optical axis I between the light-emitting surface LS of and a lens surface of the projection lens 100 furthest from the image light source 200 (i.e. magnified-side surface 112 of the first lens 110). Besides, in this embodiment, a ratio of a lens diameter D1 of the first lens L1 to an overall length OAL of all lenses is in the range between 0.4 and 2, where the lens diameter D1 is a distance between two opposite turning points P and Q of the magnified-side surface 112 measured in a direction perpendicular to the optical axis I, and the overall length OAL is a distance between two optical centers LC and SC of two outermost lens surfaces at opposite ends of the projection lens 100. It should be noted the lens diameter D1 described in this specification and claims is an actual mechanical length that includes the vertical thickness of a supporting part of a lens, but not the length of a clear aperture (CA) defined by an optical simulation software. It should be also noted values of the lens diameter D1 and overall length OAL or any ratio relative to the length parameters cannot be obtained by directly measuring the dimensions or proportion relationship from appended drawing, because these figures are only for schematic and explanatory purposes and may omit some portion and modify the actual profile of a lens.

In this embodiment, two outermost lens surfaces at opposite ends of the projection lens 100 respectively have an optical center LC and an optical center SC, and a distance between the optical center LC and the optical center SC is in the range between 30 mm and 85 mm. That is, an optical center of the magnified-side surface 112 of the first lens 110 and an optical center of the minified-side surface 134 of the third lens 130 are separate by a distance of 30 mm-85 mm, or an overall length of all lenses of the projection lens 100 measured along the optical axis I is in the range of 30 mm and 85 mm. In addition, an aspect ratio of the projection lens 100 is between 2:1 and 6:1, and the projection lens 100 may achieve a horizontal viewing angle of 14 to 40 degrees and a vertical viewing angle of 5 to 10 degrees to comply with government regulations specifying light pattern requirements.

Figure 8A:
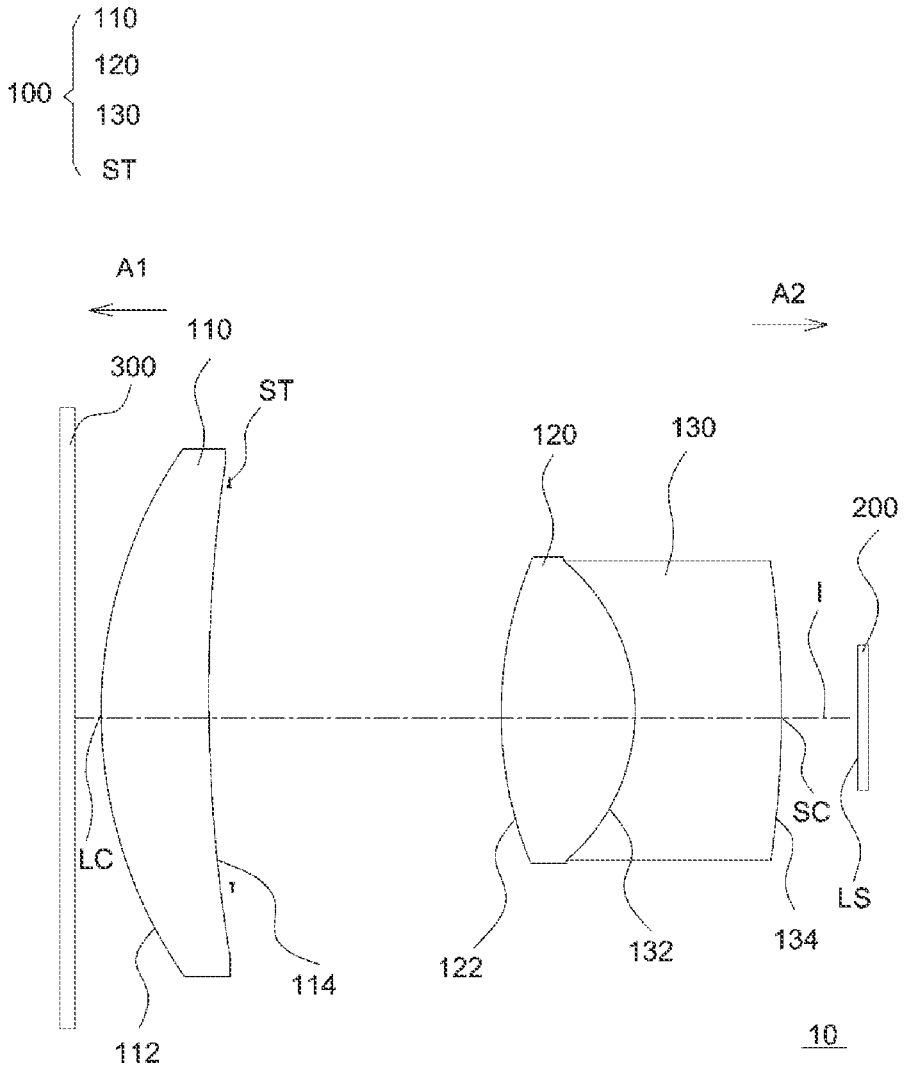
FIG. 8A shows a schematic cross-section of a vehicle lamp device in accordance with a eighth embodiment of the invention, and FIGS. 8B and 8C respectively show detailed optical data and aspheric coefficients of the vehicle lamp device of FIG. 8A.

FIG. 8A shows a schematic cross-section of a vehicle lamp device in accordance with an eighth embodiment of the invention, FIG. 8B shows detailed optical data of the vehicle lamp device of FIG. 8A, and FIG. 8C shows aspheric coefficients of the vehicle lamp device of FIG. 8A. Referring to FIGS. 8A-8C, the eighth embodiment of the vehicle lamp device 10 is similar to the seventh embodiment, except that the optical data of the eighth embodiment for the lenses 110, 120 and 130 shown in FIGS. 8B and 8C are different to those shown in FIGS. 7B and 7C.

Figure 9A:
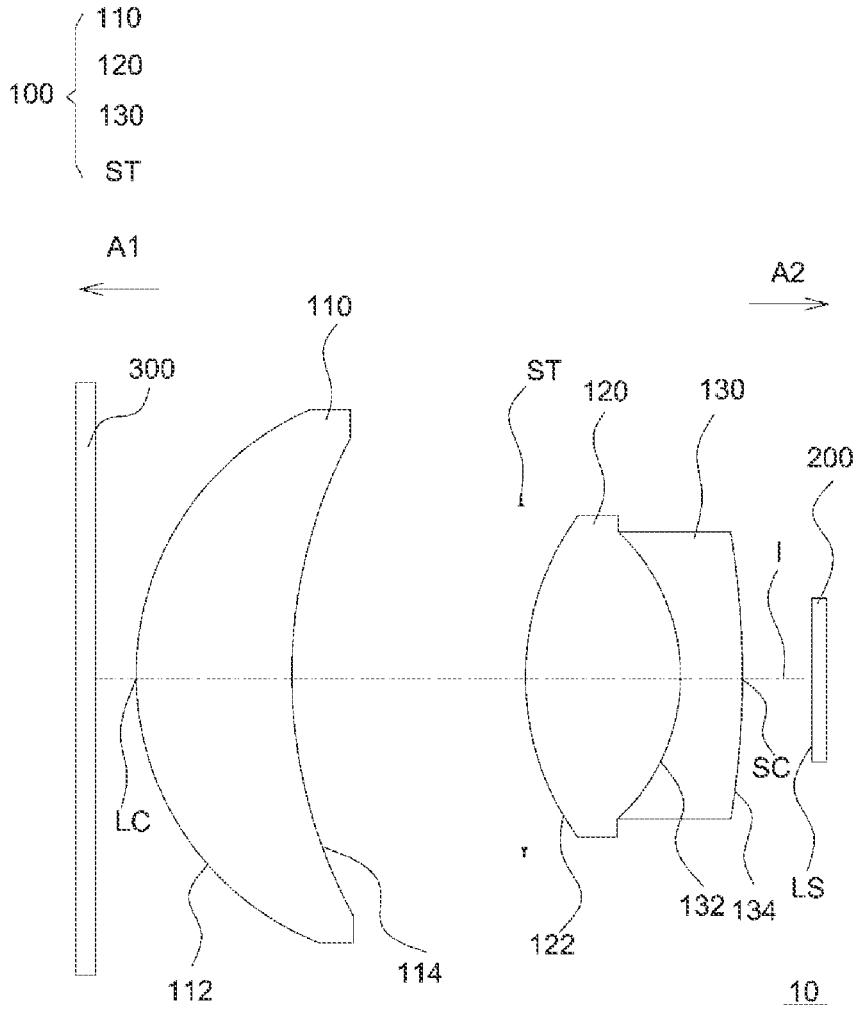
FIG. 9A shows a schematic cross-section of a vehicle lamp device in accordance with a ninth embodiment of the invention, and FIGS. 9B and 9C respectively show detailed optical data and aspheric coefficients of the vehicle lamp device of FIG. 9A.

FIG. 9A shows a schematic cross-section of a vehicle lamp device in accordance with an ninth embodiment of the invention, FIG. 9B shows detailed optical data of the vehicle lamp device of FIG. 9A, and FIG. 9C shows aspheric coefficients of the vehicle lamp device of FIG. 9A. Referring to FIGS. 9A-9C, the ninth embodiment of the vehicle lamp device 10 is similar to the seventh embodiment, except that the optical data of the ninth embodiment for the lenses 110, 120 and 130 shown in FIGS. 9B and 9C are different to those shown in FIGS. 7B and 7C.

Figure 10A:
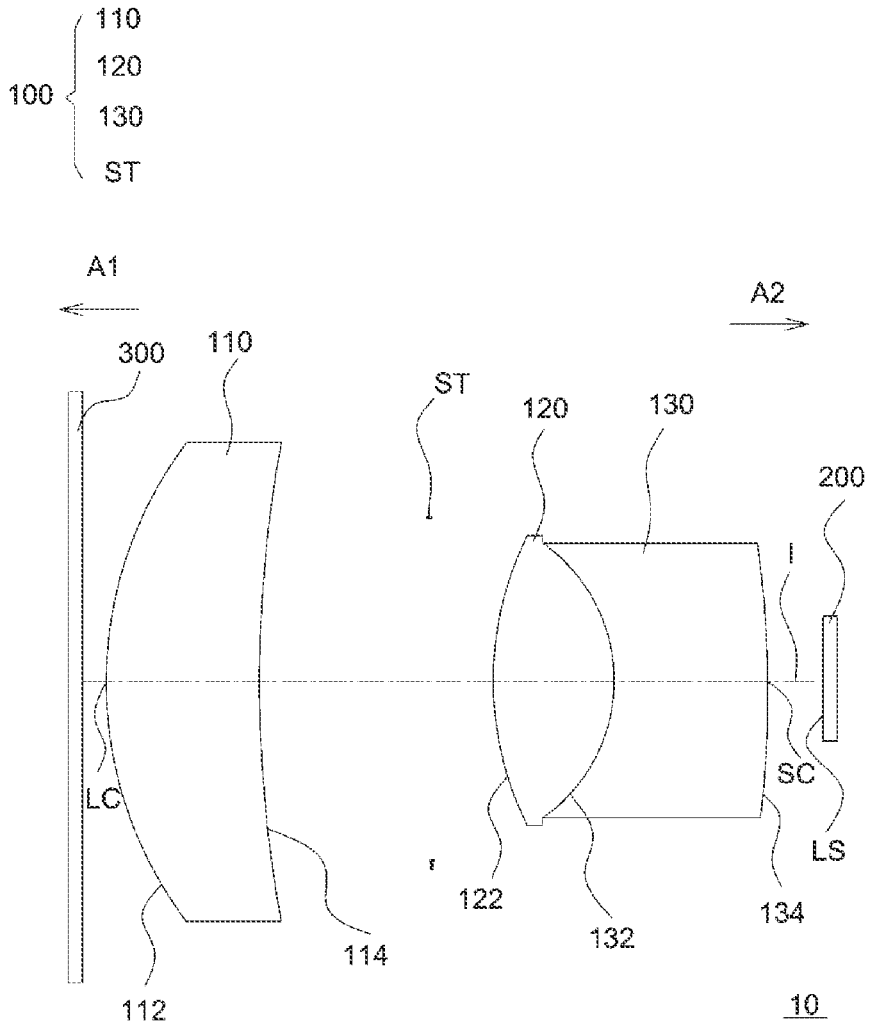
FIG. 10A shows a schematic cross-section of a vehicle lamp device in accordance with a tenth embodiment of the invention, and FIGS. 10B and 10C respectively show detailed optical data and aspheric coefficients of the vehicle lamp device of FIG. 10A.

FIG. 10A shows a schematic cross-section of a vehicle lamp device in accordance with an tenth embodiment of the invention, FIG. 10B shows detailed optical data of the vehicle lamp device of FIG. 10A, and FIG. 10C shows aspheric coefficients of the vehicle lamp device of FIG. 10A. Referring to FIGS. 10A-10C, the tenth embodiment of the vehicle lamp device 10 is similar to the seventh embodiment, except that the optical data of the tenth embodiment for the lenses 110, 120 and 130 shown in FIGS. 10B and 10C are different to those shown in FIGS. 7B and 7C.

According to the above embodiments, the projection lens may include two or three lenses with refractive powers, an overall length of all lenses with refractive powers of the projection lens measured along the optical axis is in the range of 30 mm and 85 mm, and an aspect ratio of the projection lens 100 is between 2:1 and 6:1. Besides, according to the above embodiments, the vehicle lamp device and the projection lens may have a reduced number of lenses with refractive powers, large effective aperture and high luminous efficiency for lighting or projection, and may comply with government regulations specifying safety requirements for vehicle lighting. Therefore, the design purposes of low fabrications costs, low energy consumption, and enhanced lighting and warning effects can be achieved. In addition, the projection lens in accordance with the above embodiments has a reduced total track length to enhance the assembly flexibility under the condition that the projection lens is used in vehicle lighting equipments such as a vehicle lamp device.

Though the embodiments of the invention have been presented for purposes of illustration and description, they are not intended to be exhaustive or to limit the invention. Accordingly, many modifications and variations without departing from the spirit of the invention or essential characteristics thereof will be apparent to practitioners skilled in this art. It is intended that the scope of the invention be defined by the claims appended hereto and their equivalents in which all terms are meant in their broadest reasonable sense unless otherwise indicated.

What is claimed is:

1. A vehicle lamp device, comprising:

a matrix-type image light source;

a projection lens disposed downstream from and in a light path of the matrix-type image light source, and the projection lens consisting essentially of two or three lenses with refractive powers;

an aperture stop disposed between two outermost lenses respectively at two opposite ends of the projection lens, wherein two outermost lens surfaces at the two opposite ends of the projection lens respectively have a first optical center and a second optical center, a distance between the first optical center and the second optical center is in a range between 30 mm and 85 mm, an F-number of the projection lens is in a range between 0.6 and 0.85, and an aspect ratio of the projection lens is in a range between 2.5:1 and 6:1; and a vehicle lampshade disposed downstream from and in a light path of the projection lens.

2. The vehicle lamp device as claimed in claim 1, wherein the projection lens satisfies one of the following conditions:

(1) the projection lens consists essentially of three lenses with refractive powers, and two of the three lenses are combined together to form a cemented doublet;

(2) two of the two or three lenses form a cemented doublet, and the aperture stop is disposed on one side of the cemented doublet facing away from the matrix-type image light source;

(3) the distance between the first optical center and the second optical center is in a range between 54 mm and 76 mm;

(4) two of the two or three lenses form a cemented doublet, and the aperture stop is disposed downstream from and in a light path of the cemented doublet.

3. The vehicle lamp device as claimed in claim 1, where the matrix-type image light source satisfies one of the following conditions:

(1) the matrix-type image light source has a spatial frequency of 10 line-pairs per millimeter;

(2) the matrix-type image light source has a spatial frequency of 5-15 line-pairs per millimeter;

(3) the matrix-type image light source includes multiple micro LEDs.

4. A projection lens for a vehicle lamp, comprising:

a lens set consisting essentially of two or three lenses with refractive powers;

an aperture stop disposed between two outermost lenses respectively at two opposite ends of the projection lens, an F-number of the projection lens being in a range between 0.6 and 0.85, an aspect ratio of the projection lens being in a range between 2.5:1 and 6:1, two outermost lens surfaces at the two opposite ends of the projection lens having a first optical center and a second optical center respectively, and a distance between the first optical center and the second optical center being in a range between 30 mm and 85 mm.

5. The projection lens as claimed in claim 4, wherein the projection lens satisfies one of the following conditions:

(1) all lenses with refractive powers of the projection lens have positive refractive powers;

(2) a total number of lenses with refractive powers is three, and the refractive powers of the lenses are positive, positive and negative;

(3) a total number of lenses with refractive powers is two, and the two lenses are an aspheric lens and a meniscus lens in order from a magnified side to a minified side;

(4) a total number of lenses with refractive powers is three, and the three lenses are an aspheric lens, a bi-convex lens and a meniscus lens in order from the magnified side to the minified side.

6. The projection lens as claimed in claim 4, wherein a total number of lenses with refractive powers is three, the three lenses are a first lens, a second lens and a third lens arranged in order from a magnified side to a minified side, and the projection lens satisfies one of the following conditions:

(1) a distance between the second lens and the third lens along an optical axis is greater than 1 mm;

(2) a distance between the aperture stop and the second lens along the optical axis is greater than 2 mm, (3) a thickness of the second lens measured along the optical axis is greater than 12 mm;

(4) a thickness of the second lens measured along the optical axis is greater than 6 mm.

7. The projection lens as claimed in claim 4, wherein a total number of lenses with refractive powers is two, the two lenses are a first lens and a second lens arranged in order from a magnified side to a minified side, and the projection lens satisfies one of the following conditions:

(1) a distance between the aperture stop and the second lens along the optical axis is greater than 2 mm;

(2) a thickness of the second lens measured along the optical axis is greater than 12 mm;

(3) a thickness of the second lens measured along the optical axis is greater than 6 mm.

8. The projection lens as claimed in claim 4, wherein a total track length of the projection lens is smaller than 80 mm.

9. The projection lens as claimed in claim 4, wherein the projection lens satisfies one of the following conditions:

(1) all lenses of the projection lens are formed from both glass and plastic;

(2) the projection lens does not have a cemented lens;

(3) the projection lens has at least one plastic lens.

10. The projection lens as claimed in claim 4, wherein a ratio of a lens diameter of a lens closest to a magnified side to the distance between the first optical center and the second optical center is in a range between 0.4 and 2.

11. The projection lens as claimed in claim 4, wherein the projection lens satisfies one of the following conditions:

(1) a distance between the first optical center and the second optical center being in a range between 54 mm and 76 mm, (2) the aperture stop is disposed on a surface of one of the two or three lenses.

12. The projection lens as claimed in claim 4, wherein the projection lens is used in a vehicle lamp device, the vehicle lamp device includes a matrix-type image light source and a vehicle lampshade, the projection lens is disposed downstream from and in a light path of the matrix-type image light source, and the vehicle lampshade is disposed downstream from and in a light path of the projection lens.

13. A projection lens for a vehicle lamp, comprising:

a lens set consisting essentially of an aspheric first lens and a compound lens arranged in order from a magnified side to a minified side, and a lens diameter of the first lens being greater than a lens diameter of the compound lens; and an aperture stop disposed between the compound lens and the magnified side, an F-number of the projection lens being in a range between 0.6 and 0.85, and an aspect ratio of the projection lens being in a range between 2:1 and 6:1;

wherein two outermost lens surfaces at two opposite ends of the projection lens respectively have a first optical center and a second optical center, and a distance between the first optical center and the second optical center is in a range between 30 mm and 85 mm.

14. The projection lens as claimed in claim 13, wherein the projection lens satisfies one of the following conditions:

(1) all lenses with refractive powers of the projection lens have positive refractive powers;

(2) a total number of lenses with refractive powers is three, and the refractive powers of the lenses are positive, positive and negative;

(3) a total number of lenses with refractive powers is three, and the three lenses are an aspheric lens, a bi-convex lens and a meniscus lens in order from the magnified side to the minified side.

15. The projection lens as claimed in claim 13, wherein the compound lens is composed of a second lens and a third lens arranged in order from the magnified side to the minified side, and the projection lens satisfies one of the following conditions:

(1) a distance between the second lens and the third lens along an optical axis is greater than 1 mm;

(2) a distance between the aperture stop and the second lens along the optical axis is greater than 2 mm;

(3) a thickness of the second lens measured along the optical axis is greater than 12 mm;

(4) a thickness of the second lens measured along the optical axis is greater than 6 mm.

16. The projection lens as claimed in claim 13, wherein a total track length of the projection lens is smaller than 80 mm.

17. The projection lens as claimed in claim 13, wherein the projection lens satisfies one of the following conditions:

(1) all lenses of the projection lens are formed from both glass and plastic;

(2) the projection lens has at least one plastic lens.

18. The projection lens as claimed in claim 13, wherein two outermost lens surfaces at the two opposite ends of the projection lens have a first optical center and a second optical center respectively, and a ratio of the lens diameter of the first lens closest to the magnified side to the distance between the first optical center and the second optical center is in a range between 0.4 and 2.

19. The projection lens as claimed in claim 13, wherein the projection lens satisfies one of the following conditions:

(1) two outermost lens surfaces at the two opposite ends of the projection lens have a first optical center and a second optical center respectively, and a distance between the first optical center and the second optical center is in a range between 5 mm and 76 mm;

(2) an aspect ratio of the projection lens is in a range between 2.5:1 and 6:1;

(3) the aperture stop is disposed on a surface of one of the lenses.

20. The projection lens as claimed in claim 13, wherein the projection lens is used in a vehicle lamp device, the vehicle lamp device includes a matrix-type image light source and a vehicle lampshade, the projection lens is disposed downstream from and in a light path of the matrix-type image light source, and the vehicle lampshade is disposed downstream from and in a light path of the projection lens.

* * * * *